US006273537B1

(12) United States Patent
Hiwada

(10) Patent No.: US 6,273,537 B1
(45) Date of Patent: Aug. 14, 2001

(54) ACTUATOR DRIVING CIRCUIT

(75) Inventor: Shuhei Hiwada, Nagoya (JP)

(73) Assignee: Brother Kogyo Kabushiki Kaisha, Nagoya (JP)

( * ) Notice: Subject to any disclaimer, the term of this patent is extended or adjusted under 35 U.S.C. 154(b) by 0 days.

(21) Appl. No.: 09/313,654

(22) Filed: May 18, 1999

(30) Foreign Application Priority Data

May 19, 1998 (JP) ..... 10-136710

(51) Int. Cl.[7] ..... B41J 29/38; B41J 2/045
(52) U.S. Cl. ..... 347/10; 347/9; 347/68
(58) Field of Search ..... 347/9, 10, 11, 347/68

(56) References Cited

U.S. PATENT DOCUMENTS 5,347,300 * 9/1994 Futagawa ..... 347/9
5,646,661 7/1997 Asai et al. ..... 347/69
6,113,209 * 8/2000 Nitta et al. ..... 347/9

* cited by examiner

*Primary Examiner*—John E. Barlow, Jr.
*Assistant Examiner*—Alfred Dudding
(74) *Attorney, Agent, or Firm*—Oliff & Berridge, PLC

(57) ABSTRACT

A drive circuit for driving a piezoelectric element print head actuator that has characteristic wherein its capacitance increases in association with increase in applied drive voltage. The drive circuit includes transistors for outputting a drive voltage of a waveform to the actuator (capacitor), and an element drive circuit for driving the transistors. One of the transistors is for charging the capacitor and the other transistor is for discharging the capacitor. Both of the transistors have a characteristic wherein their ON resistance decreases with increase in the applied drive voltage. The element drive circuit has a characteristic for driving the transistors while shortening the rising edge time and falling edge time of the drive waveform for driving the transistors in accordance with increase in the drive voltage amount. In this way, the transistors and the element drive circuit cancel out the characteristic of the actuator.

20 Claims, 10 Drawing Sheets

ACTUATOR DRIVING CIRCUIT

BACKGROUND OF THE INVENTION

1. Field of the Invention

The present invention relates to an actuator driving circuit.

2. Description of Related Art

An ink jet printer is provided with an ink jet print head. In one type of the ink jet printer, the ink jet print head is formed form piezoelectric material. The print head is provided with a plurality of side walls for defining a plurality of ink chambers. Each ink chamber is filled with ink. A nozzle is provided in fluid communication with each ink chamber. Each side wall serves as an actuator. That is, when the side wall is applied with a drive voltage, the side wall is bent, thereby changing the volume of the corresponding ink chamber. Due to the change in the ink chamber volume, an ink droplet is ejected from the ink chamber through the corresponding nozzle. The thus ejected ink droplet will form characters and images on a sheet of paper.

SUMMARY OF THE INVENTION

FIG. 1 is a circuit diagram of a conceivable ink jet print head 1000. Each side wall or actuator 1005 operates in a manner of a capacitor, and therefore is represented in FIG. 1 as a capacitor C. As shown in FIG. 1, the print head 1000 is connected to a drive integrated circuit (IC) 2000. The drive IC 2000 includes a plurality of driver circuits 1001, each for driving a corresponding actuator (capacitor C) 1005. More specifically, each actuator (capacitor C) 1005 is connected to a corresponding driver circuit 1001 via a resistor R.

The driver circuit 1001 is designed to apply a fixed voltage to each actuator (capacitor C) 1005. When one actuator (capacitor C) 1005 is applied with the fixed voltage, the actuator (capacitor C) 1005 gradually charges up and deforms, thereby increasing the volume of a corresponding ink chamber. Ink is supplied into the ink chamber. When the driver circuit 1001 stops the application of the voltage to the actuator 1005, the actuator 1005 gradually discharges, and returns to its original shape. As a result, the volume of the ink chamber reduces, and ink is ejected from the ink chamber via a corresponding nozzle.

Properties, such as viscosity, of the ink change according to an ambient temperature during printing. It is therefore desirable to perform a minute control for changing the amount of the drive voltage, according to the changes in properties of the ink, thereby changing the amount that the actuator deforms.

It is noted, however, that the actuator 1005 is formed from piezoelectric material and therefore capacitance of the actuator 1005 increases with increase in the drive voltage applied to the actuator 1005. Accordingly, if the drive voltage is changed in accordance with changes in properties of the ink, then the capacitance of the actuator 1005 will also change, which affects the ink ejection property as described below.

Generally, when the actuator (capacitor C) 1005 is applied with a drive voltage form the corresponding driver circuit 1001, a voltage is developed at the actuator (capacitor C) 1005 in a manner that the amount of the developed voltage changes in time as shown in FIG. 2. In FIG. 2, a rising edge time Tr is defined as a time duration from when the voltage is first applied to the actuator 1005 to when the actuator 1005 deforms. A falling edge time Tf is defined as a time duration from when an application of the voltage stops to when the actuator 1005 returns to its original shape. More specifically, when the actuator (capacitor) 1005 is charged 100%, the actuator 1005 deforms at a maximum. In this example, the rising edge time Tr is defined as the time duration from when the actuator (capacitor) 1005 is charged 10% to when the actuator (capacitor) 1005 is charged 90%. The falling edge time Tf is defined as the time from when the actuator (capacitor) 1005 is discharged 10% to when the actuator (capacitor) 1005 is discharged 90%. Both the rising edge time Tr and the falling edge time Tf are important parameters in ejection characteristics of the print head 1000.

When the amount of the drive voltage applied to the actuator (capacitor C) 1005 is increased, however, the capacitance of the actuator (capacitor C) 1005 also increases. Accordingly, both the rising edge time Tr and the falling edge time Tf will increase. It becomes impossible to maintain the desired ejection characteristics of the print head 1000. In order to ensure that the ejection characteristics be as desired, the amount of the drive voltage can be changed only over a very narrow range.

It is conceivable to select the material forming the actuator 1005 so that the capacitance of the actuator 1005 will not change with the changes in the amount of the applied drive voltage. However, in this case, the actuator becomes incapable of producing a sufficient displacement amount required to eject ink. Accordingly, this method is not applicable to the print head.

In view of the above-described drawbacks, it is an objective of the present invention to provide an improved actuator drive circuit that is capable of maintaining the rising edge time and the lowering edge time of the actuator drive as substantially fixed, regardless of changes in the amount of the applied drive voltage.

In order to attain the above and other objects, the present invention provides a drive circuit for applying a drive voltage to an actuator whose capacitance increases with increase in an amount of the drive voltage, the drive circuit comprising: an output element for outputting a drive voltage in a driving waveform; and an element driving circuit for driving the output element, at least one of the output element and the element driving circuit having a characteristic to decrease a rising edge time period and a falling edge time period of the driving waveform in accordance with increase in the amount of the drive voltage.

Because the actuator has the characteristic that its capacitance increases with increase in the amount of the applied drive voltage, the time required for the actuator to be electrically charged and the time required for the actuator to be discharged increases as the amount of voltage applied to the actuator increases. The driving waveform applied to the actuator by the output element, that is driven by the element driving circuit, is controlled such that the rising edge time and the falling edge time are decreased as the amount of the voltage applied to the actuator increases. Accordingly, the characteristic of the actuator is cancelled out. Regardless of changes in the amount of the voltage applied to the actuator, the rising edge time and the falling edge time of the actuator drive can be maintained as substantially being fixed.

At least one of the output element and the element driving circuit may have a characteristic to increase a rate, at which the drive voltage rises to a predetermined driving level and falls from the predetermined driving level in the driving waveform, in accordance with increase in the value of the predetermined driving level.

The output element may include: a first transistor for electrically charging the actuator; and a second transistor for electrically discharging the actuator, each of the first and second transistors having an ON resistance that decreases according to increase in an amount of an output element driving voltage outputted form the element driving circuit to each of the first and second transistors.

Each of the first and second transistors has characteristics wherein its ON resistance decreases according to increase in an amount of the output element driving voltage applied thereto. Accordingly, as the amount of the output element driving voltage applied to each transistor increases, the amount of the electric current flowing through each transistor increases, whereby the time period required to electrically charge the actuator and the time period required to electrically discharge the actuator is decreased. Thus, the above-described characteristics of the actuator is cancelled out. As a result, the rising edge time and the falling edge time of the actuator driving operation is maintained as substantially fixed.

The element driving circuit may perform a driving operation to output the output element driving voltage in an element driving waveform, while decreasing a rising edge time and a falling edge time of the driving waveform when increasing the amount of the output element driving voltage. For example, the element driving circuit may output the output element driving voltage while increasing a rate, at which the output element driving voltage rises to a predetermined element driving level and falls from the predetermined element driving level in the element driving waveform, in accordance with increase in the value of the predetermined element driving level. Accordingly, the above-described characteristics of the actuator can be cancelled out, and therefore the rising edge time and the falling edge time of the actuator drive can be maintained as substantially fixed.

The actuator may define an ink chamber for being filled with ink, the actuator being formed with a nozzle in fluid communication with the ink chamber, the output element allowing the actuator to actuate upon application of the drive voltage, thereby causing ejection of an ink droplet through the nozzle from the ink chamber. The drive circuit has a characteristic to decrease the rising edge time and the falling edge time of the driving waveform according to the increase in the amount of the drive voltage. Accordingly, when the actuator is a print head actuator whose capacitance increases as the increase in the applied voltage, this characteristic can be cancelled out by the drive circuit. Accordingly, the rising edge time and the falling edge time of the actuator drive can be maintained substantially fixed regardless of the amount of the drive voltage. The print head can therefore eject ink droplets at a stable fixed timing.

According to another aspect, the present invention provides an actuator device, comprising: an actuator whose capacitance increases with increase in an amount of a drive voltage applied thereto; and a drive circuit for applying the drive voltage to the actuator, the drive circuit applying the drive voltage in a driving waveform while decreasing a rising edge time period and a falling edge time period of the driving waveform in accordance with increase in the amount of the drive voltage.

According to still another aspect, the present invention provides a print head for an ink jet printer, the print head comprising: an actuator defining an ink chamber for being filled with ink, the actuator being formed with a nozzle in fluid communication with the ink chamber, capacitance of the actuator increasing with increase in an amount of a drive voltage applied thereto; and a drive circuit for applying the drive voltage in a driving waveform to the actuator, thereby allowing the actuator to actuate and cause ejection of an ink droplet through the nozzle from the ink chamber, the drive circuit decreasing a rising edge time period and a falling edge time period of the driving waveform in accordance with increase in the amount of the drive voltage.

BRIEF DESCRIPTION OF THE DRAWINGS

The above and other objects, features and advantages of the invention will become more apparent from reading the following description of the preferred embodiment taken in connection with the accompanying drawings in which:

FIG. 5B is another schematic view showing the operation of the ink jet print head of FIG. 3;

DETAILED DESCRIPTION OF THE PREFERRED EMBODIMENT

Figure 1:
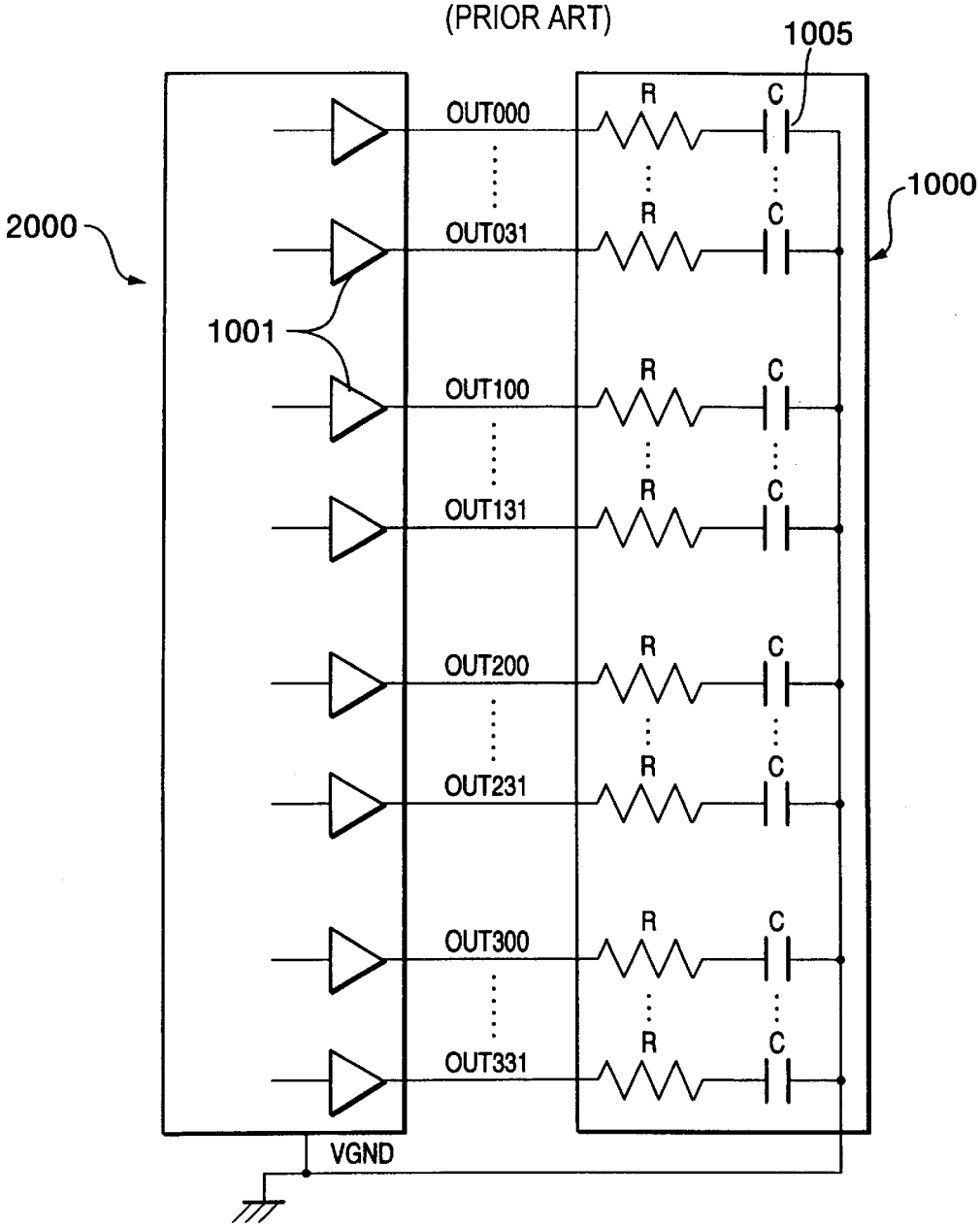
FIG.1 (PRIOR ART)
FIG. 1 is a circuit diagram of a conceivable drive circuit.
Figure 2:
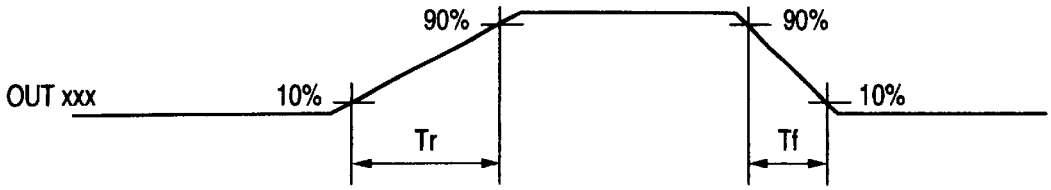
FIG.2 (PRIOR ART)
FIG. 2 is a timing chart illustrating how the drive voltage developed to an actuator changes in time.

An actuator drive circuit according to a preferred embodiment of the present invention will be described while referring to the accompanying drawings wherein like parts and components are designated by the same reference numerals to avoid duplicating description.

First, an ink jet print head driven by the actuator drive circuit of the present embodiment will be described with reference to FIGS. 3 through 5B.

Figure 3:
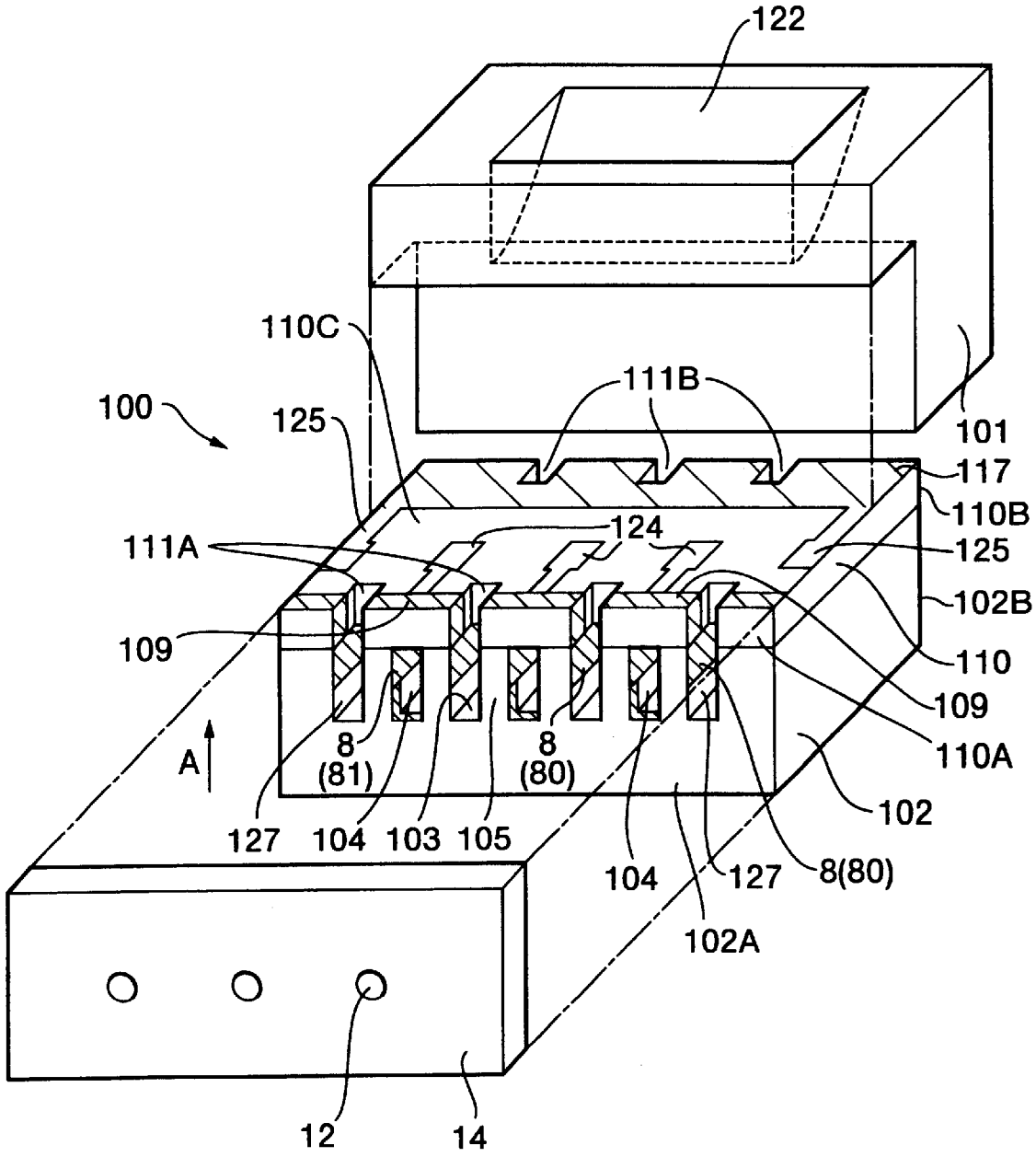
FIG. 3 is a perspective view showing an ink jet print head, to which applied is a drive circuit according to an embodiment of the present invention.

As shown in FIG. 3, the ink jet print head 100 is comprised from: an actuator plate 102, a cover plate 110, a nozzle plate 14, and a manifold portion 101.

the actuator plate 102 is formed of ceramic material of lead zirconate titanate group (PZT). A plurality of grooves 103 are formed on the actuator plate 102. Side walls 105, which serve as the side surfaces of the grooves 103, are polarized in a direction as indicated by an arrow A. The grooves 103 are opened at both end surfaces 102A and 102B of the actuator plate 102. A metal electrode 8 is formed at an upper half portion of both side surfaces of the inner surface of each groove 103.

The cover plate 110 is formed of alumina. Slits 111A and 111B are formed on the facing end surfaces 110A and 110B of the cover plate 110, respectively. The pitch of the slits 111A, 111B is set to two times the pitch of the grooves 103, and the slits 111A and 111B are alternately arranged so as to deviate from one another by a half pitch. The slits 111A and 111B are thus provided in correspondence with the grooves 103. Further, conductive patterns 124 and 125 are formed on the top surface 110C of the cover plate 110.

Figure 5A:
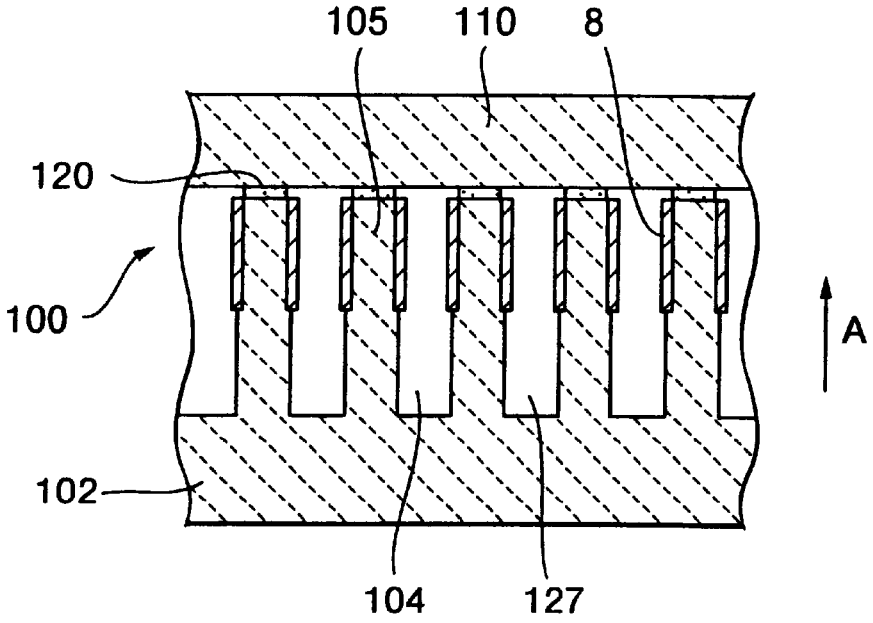
FIG.5A (PRIOR ART)
FIG. 5A is a schematic view showing the operation of the ink jet print head of FIG. 3.
Figure 5A:
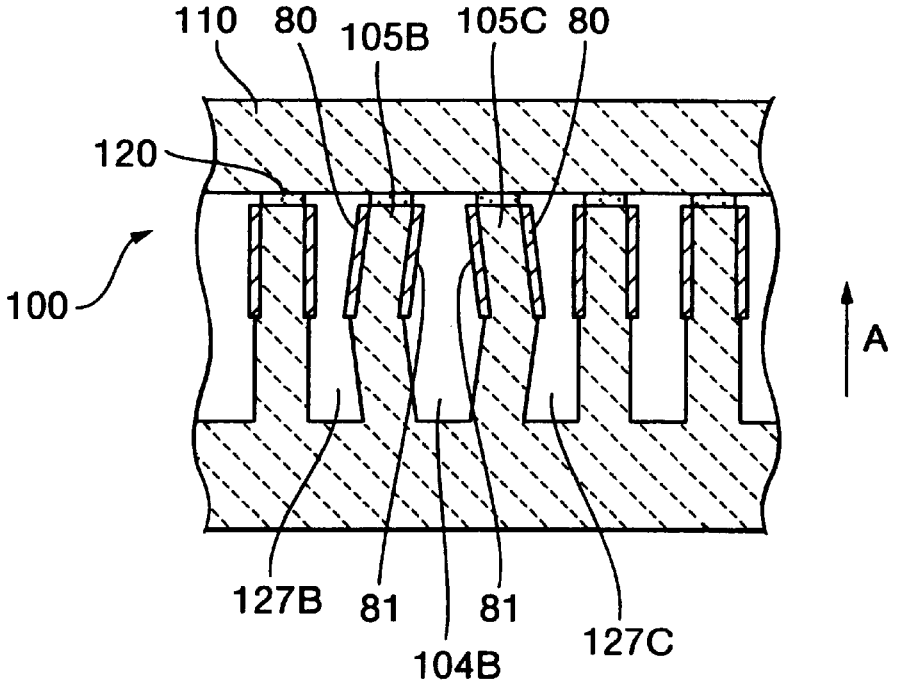
FIG.5AB (PRIOR ART)

The surface of the actuator plate 102, on which the grooves 103 are formed, is adhesively attached to the surface, opposite to the surface 110C, of the cover plate 110 with adhesive agent 120 (FIG. 5A). Some of the grooves 103 that are in fluid communication with the slits 111B serve as ink chambers 104 for being filled with ink. Remaining grooves 103 that are in fluid communication with the slits 111A serve as air chambers 127 for being filled with air. The ink chambers 104 and the air chambers 127 are therefore arranged alternately. The metal electrode 8 in each ink chamber 104 serves as a common electrode 81, and the metal electrode 8 in each air chamber 127 serves as a drive electrode 80. In other words, one electrode 8 formed on the side wall 105 at the ink chamber 104 side is a common electrode 81, and the other electrode 8 formed on the side wall 105 at the air chamber 127 side is a drive electrode 80.

Metal electrodes 109 are formed on the surface 110C of the cover plate 110 at the end surface 110A side, and extend through the slits 111A to be electrically connected to the drive electrodes 80 in the air chambers 127. With this structure, each metal electrode 109 ensures that a drive electrode 80, formed on one side wall 105, which is located at one side of one air chamber 127 to partially define an ink chamber 104, be electrically connected to another drive electrode 80 formed on another side wall 105, which is located at one side of another air chamber 127 and completes the definition of the subject ink chamber 104 which is sandwiched between the two side walls 105. The metal electrodes 109 are electrically connected to the conductive patterns 124, respectively.

Another metal electrode 117 is formed on the surface 110C to extend from approximately the middle of the cover plate 110 to the end surface 110B side. The metal electrode 117 further extends through the slits 111B into all the ink chambers 104. The metal electrode 117 is therefore electrically connected to the common electrodes 81 in all the ink chambers 104 that are in fluid communication with the slits 111B. Therefore, the common electrodes 81 in all the ink chambers 104 are electrically connected to one another through the metal electrode 117. The metal electrode 117 is electrically connected to the other conductive pattern 125.

A nozzle plate 14 having nozzles 12, which are located at positions corresponding to the ink chambers 104, is adhesively attached to the end surface 102A of the actuator plate 102 and the end surface 110A of the slit 111A side of the cover plate 110. The nozzle plate 14 is formed of plastic material.

The manifold portion 101 is adhesively attached to the end surface 102B of the actuator plate 102, the end surface 110B of the cover plate 110 and the surface 110C of the cover plate 110. A manifold 122 is formed in the manifold portion 101. The manifold 122 is formed in the manifold portion 101. The manifold 122 surrounds the slits 111B so as to be in fluid communication with all the ink chambers 104 via the slits 111B.

The conductive patterns 124 and 125, formed on the cover plate 110, are connected to a wiring pattern on a flexible print board (not shown). The wiring pattern on the flexible print board is connected to a rigid board (not shown) which is connected to a controller described below.

Figure 4:
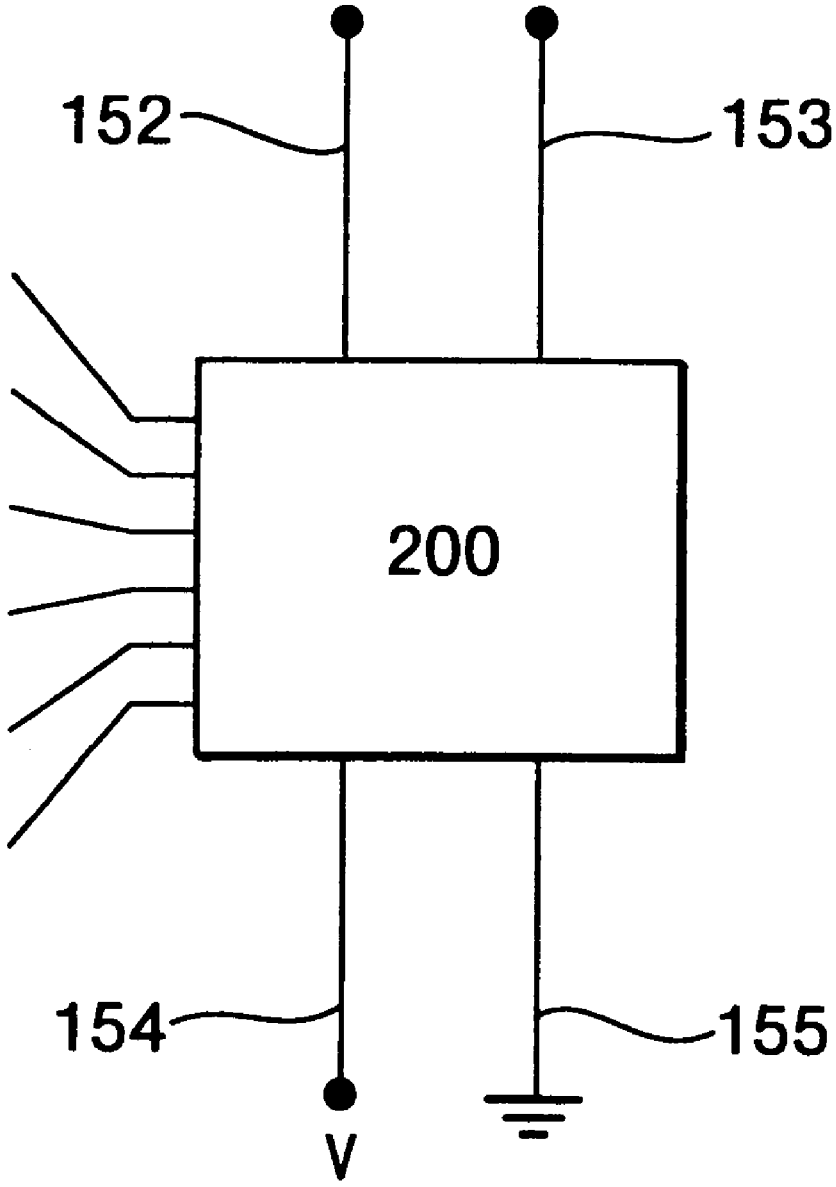
FIG. 4 is a block diagram showing a controller of the ink jet print head of FIG. 3.

Next, the structure of the controller will be described with reference to FIG. 4.

Each of the conductive patterns 124 and 125 formed on the cover plate 110 is individually connected to a driving IC 200 through the flexible print board and the rigid board. A clock line 152, a data line 153, a voltage line 154, and a ground line 155 are also connected to the driving IC 200. The driving IC 200 connects the pattern 125, connected to the common electrodes 81 of all the ink chambers 104, to the ground line 155. In response to continuous clock pulses supplied from the clock line 152, the driving IC 200 identifies a nozzle 12, from which an ink ejecting operation of an ink droplet is to be performed, on the basis of data inputted on the data line 153. The driving IC 200 then applies a drive voltage to a single pattern 124 that is connected to drive electrodes 80 in a pair of air chambers 127 that are located at both sides of the subject ink chamber 104, from which the ink is to be ejected. Further, the driving IC 200 connects the other patterns 124 to the ground line 155.

With the above-described structure, the ink jet print head 100 operates as described below.

In order to eject an ink droplet from subject ink chamber 104B, shown in FIG. 5B, a drive voltage is applied through one conductive pattern 124 to a pair of drive electrodes 80 and 80 that are located as being exposed in the air chambers 127B and 127C. The air chambers 127B and 127C are located sandwiching the subject ink chamber 104B therebetween. The common electrodes 81 and 81 that are located as being exposed in the subject ink chamber 104B are grounded through the pattern 125. As a result, an electric field occurs in the side walls 105B and 105C so that the side walls 105B and 105C deform in directions away from each other. Accordingly, the volume of the subject ink chamber 104B is increased, and ink is supplied from the manifold 122 through the slit 111B associated with subject ink chamber 104B. When the application of the drive voltage to the drive electrodes 80 and 80 is stopped, the side walls 105B and 105C are returned to their original states (FIG. 5A). Accordingly, the volume of the subject ink chamber 104B is reduced to its original amount, and therefore an ink droplet is ejected from the corresponding nozzle 12. Details of the structure and the operation of the ink jet print head 100 are shown, for example, in U.S. Pat. No. 5,646,662, the disclosure of which is hereby incorporated by reference.

Figure 6:
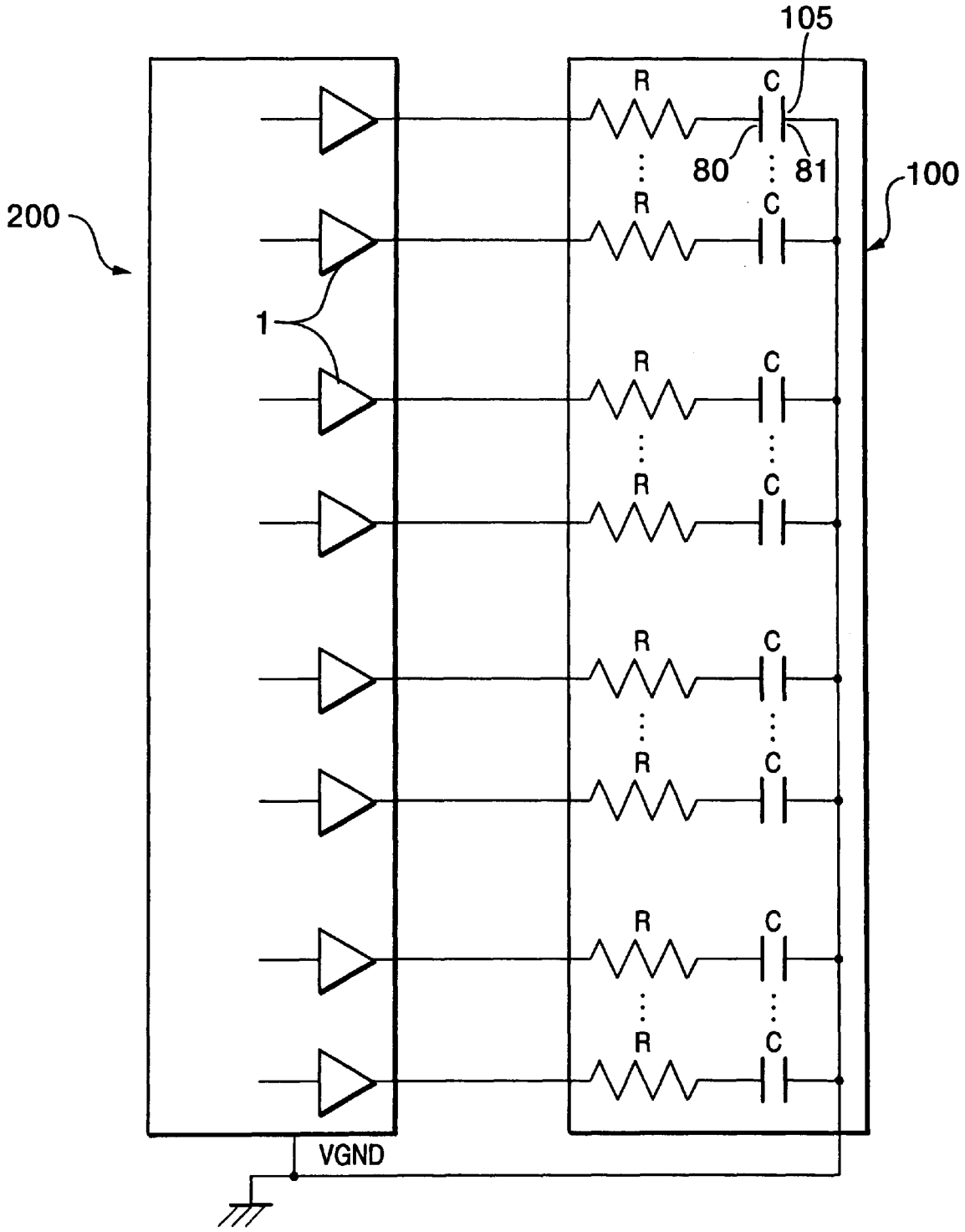
FIG. 6 is a circuit diagram of an equivalent circuit of the ink jet print head of FIG. 3 and a drive IC of FIG. 4 according to the present embodiment.

FIG. 6 is a circuit diagram showing an equivalent circuit of the above-described ink jet print head 100 and the drive IC 200.

Each side wall 105 operates in a manner of a capacitor, and therefore is represented in FIG. 6 as a capacitor C. As shown in FIG. 6, the driver IC 200 includes a plurality of driver circuits 1, each for driving a corresponding actuator (capacitor C) 105 in the print head 100. More specifically, the drive electrode 80 of each actuator 105 is connected to a corresponding driver circuit 1. The common electrode 81 of each actuator 105 is grounded. The driver circuit 1 is designed to apply the drive voltage of a predetermined waveform to the drive electrode 80 on the corresponding actuator (capacitor C) 105. When the drive electrode 80 of the actuator 105 is thus applied with the drive voltage, the actuator (capacitor C) 105 gradually charges up and deforms, thereby allowing ink to be supplied to the corresponding ink chamber 104. The driver circuit 1 then stops the application of the drive voltage to the actuator (capacitor C) 105. As a result, the actuator 105 gradually discharges and returns to its original shape, whereupon ink is ejected from the ink chamber 104 via the corresponding nozzle 12.

Figure 7:
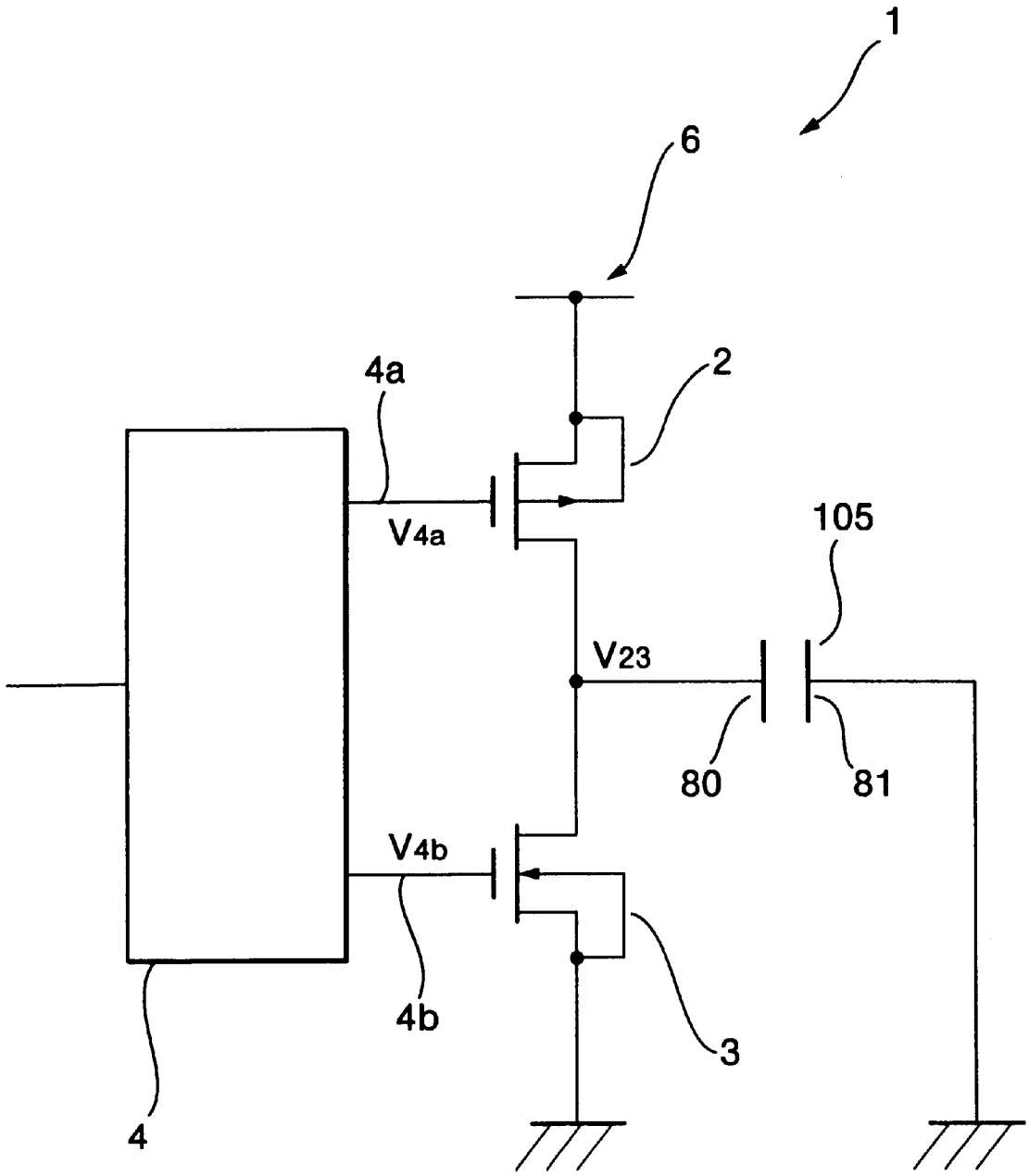
FIG. 7 is a circuit diagram of a drive circuit, according to the embodiment, the drive circuit being provided in the drive IC of FIG. 6 for driving an actuator in the print head.

FIG. 7 is a circuit diagram showing each driver circuit 1 of the present embodiment for driving the corresponding actuator (capacitor) 105.

As shown in FIG. 7, the driver circuit 1 includes: a pair of transistors 2 and 3; and an element drive circuit 4. It is noted that in this figure, the resistor R (FIG. 6) provided between the driver circuit 1 and the actuator 105 is omitted because the resistance of the resistor R is considerably smaller than ON resistances of the transistors 2 and 3.

The transistors 2 and 3 are field effect transistors (MOSFETs, in this example). The transistors 2 and 3 serve as output elements that cooperate to output a drive voltage V23 of a predetermined waveform (FIG. 9A) to the actuator (capacitor) 105. The transistor 2 charges up the actuator (capacitor) 105, and the transistor 3 discharges the actuator (capacitor) 105.

The element drive circuit 4 is for driving the transistors 2 and 3 through applying element drive voltages V4*a* and V4*b* (FIG. 9A) to the transistors 2 and 3, thereby controlling the transistors 2 and 3 to output the driving voltages V23 of the predetermined waveform.

As described already, the actuator (capacitor) 105 is formed from piezoelectric material. The actuator 105 therefore operates in a manner similar to a capacitor, and has a positive property wherein its capacitance increases with increase in the amount of the applied drive voltage V23. In this example, the capacitance increases by about 2.4%, for example, for each volt increase in the applied drive voltage V23.

As shown in FIG. 7, the element drive circuit 4 has a pair of output terminals 4*a* and 4*b*, which are connected to gate terminals of the transistors 2 and 3, respectively. A voltage source 6 is provided to be electrically connected to a source terminal of the transistor 2. The voltage source 6 is provided by the voltage line 154 (FIG. 4). One terminal of the actuator (capacitor) 105, that is, the drive electrode 80 is electrically connected to drain terminals of both the transistors 2 and 3. The other terminal of the actuator (capacitor) 105, that is, the common electrode 81 is grounded. A source terminal of the transistor 3 is grounded. Each element drive voltage V4*a*, V4*b* is therefore a gate-source voltage developed between the gain and the source in the corresponding transistor 2, 3. The drive voltage V23 is a drain voltage developed at the drains of the transistors 2 and 3 in response to the element drive voltages V4*a*, V4*b*.

With this structure, when the element drive voltage V4*a* of a certain amount is applied to the gate of the transistor 2, an electric current flows from the voltage source 6 through the transistor 2, thereby gradually charging up the actuator 105. In other words, the drain voltage V23 gradually increases to a certain amount, and the actuator 105 deforms. When the application of the element drive voltage V4*a* is stopped and the other element drive voltage V4*b* of a certain amount is applied to the gate of the transistor 3, an electric current flows from the actuator 105 through the transistor 3, thereby gradually discharging the actuator 105. In other words, the drain voltage V23 gradually decreases, and the actuator 105 restores its original shape.

Each transistor 2, 3 has an ON resistance (drain-source resistance) whose amount decreases in accordance with increases of the inputted drive voltage V4*a*, V4*b* (gate-source voltage). Accordingly, when a small amount of the drive voltage V4*a* is applied to the transistor 2, a small amount of an electric current flows through the transistor 2 that presently has a large on-resistance. Accordingly, the drain voltage V23 rises slowly to a level that corresponds to the amount of the drive voltage V4*a*. On the other hand, when a large amount of the drive voltage V4*a* is applied to the transistor 2, a large amount of an electric current flows through the transistor 2 that presently has a small on-resistance. Accordingly, the drain voltage V23 will rapidly rise to a higher level that corresponds to the increased amount of the drive voltage V4*a*. Similarly, when a small amount of the drive voltage V4*b* is applied to the transistor 3, a small amount of the electric current flows through the transistor 3 that presently has a large on-resistance. Accordingly, the drain voltage V23 falls slowly. However, when a large amount of the drive voltage V4*b* is applied to the transistor 3, a large amount of the electric current flows through the transistor 3 that presently has a small on-resistance. Accordingly, the drain voltage V23 will rapidly fall. Thus, as the amounts of the voltages V4*a* and V4*b* are increased in order to increase the amount of the drain voltage V23 rises and falls, also increases, thereby decreasing the time period required for the voltage V23 to rise and the time period required for the voltage V23 to fall. Thus, the transistors 2 and 3 are designed to perform a driving operation of the actuator 105 while decreasing the rising edge time and the falling edge time of the drive waveform V23 in accordance with increase in the amount of the drive voltage V23.

The above-described characteristics of the transistors 2 and 3 can cancel out the characteristic of the actuator 105 whose capacitance increases with increase in the amount of the applied voltage V23. That is, even when the capacitance of the actuator 105 increases according to the increase of the level of the drain voltage V23, both the rising edge time Tr and the falling edge time Tf of the drive waveform V23 can be maintained as being substantially fixed.

Additionally, according to the present embodiment, the element drive circuit 4 is designed to perform a driving operation to output the voltage V4*a* and V4*b*, while decreasing the rising edge time and the falling edge time of the drive waveforms V4*a* and V4*b* in accordance with increase in the amounts of the drive voltages V4*a* and V4*b*.

Figure 8:
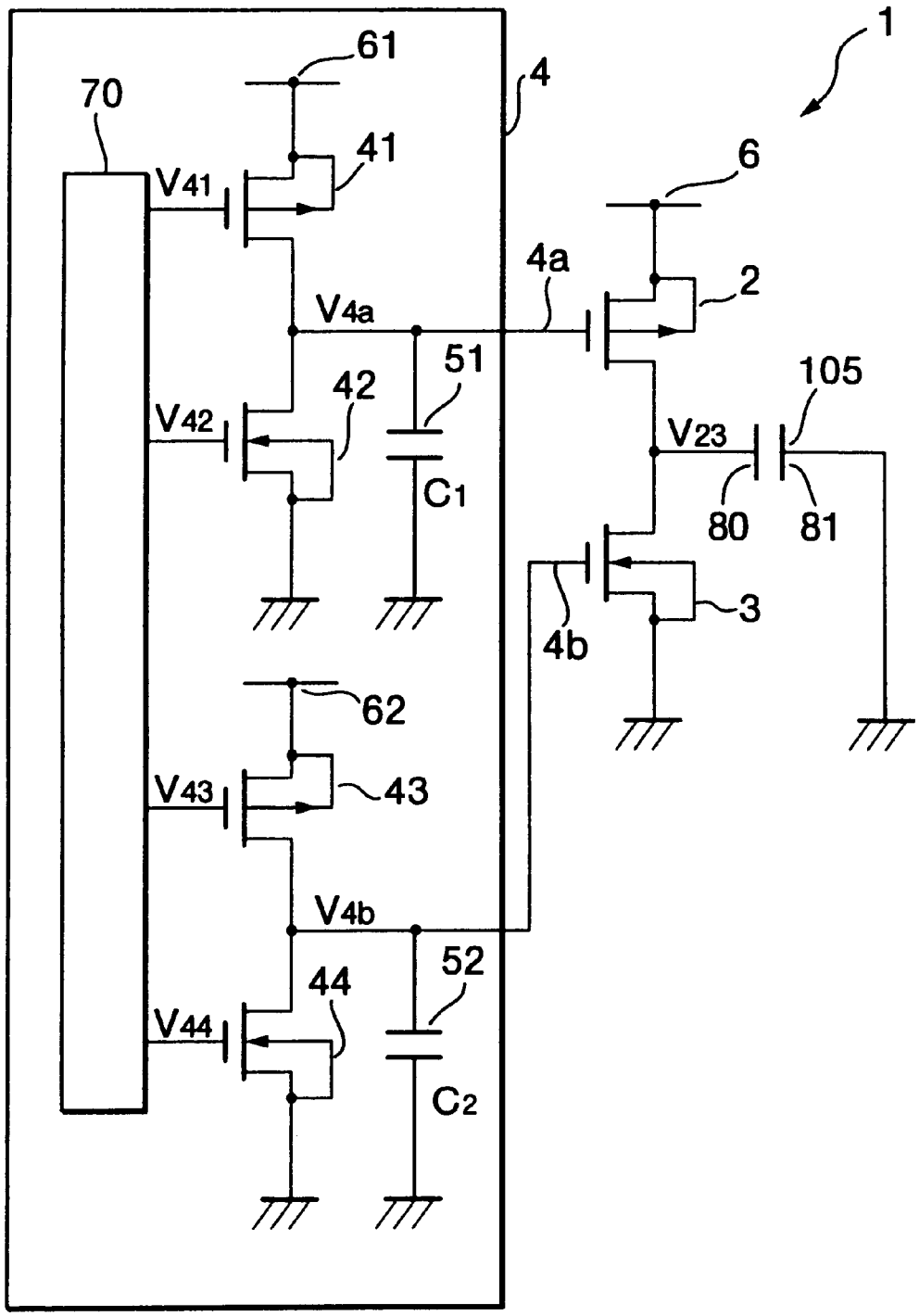
FIG. 8 is a circuit diagram showing a detailed structure of an element driving circuit in the drive circuit of FIG. 7.

One example of the structure of the element drive circuit 4 is shown in FIG. 8.

As shown in FIG. 8, the element drive circuit 4 includes: a first voltage source 61; a first pair of transistors 41 and 42; a first capacitor 51 (C1); a second voltage source 62; a second pair of transistors 43 and 44; a second capacitor 52 (C2); and a control portion 70. It is noted that the first and second voltage sources 61 and 62 are provided also from the voltage line 154 (FIG. 4).

Each of the transistor 41–44 is a field effect transistor (MOSFET, in this example). The first voltage source 61 is connected to a source terminal of the transistor 41. Drain terminals of both of the transistors 41 and 42 are connected to one terminal of the capacitor 51 and to the output terminal 4*a*. The other terminal of the capacitor 51 is grounded. A source terminal of the transistor 42 is also grounded. The second voltage source 62 is connected to a source terminal of the transistor 43. Drain terminals of both of the transistors 43 and 44 are connected to one terminal of the capacitor 52 and to the output terminal 4*b*. The other terminal of the capacitor 52 is grounded. A source terminal of the transistor 44 is also grounded.

With this structure, the element drive circuit 4 operates as described below.

When desiring to output the element output voltage V4*a* of a desired amount, a voltage V41 of a corresponding amount is first applied to the gate of the transistor 41. As a result, an electric current flows through the transistor 41 from the voltage source 61 to charge up the capacitor 51 (C1), whereby the element output voltage V4*a* rises to the desired amount. When desiring to stop outputting the element output voltage V4*a,* a voltage V42 of the corresponding amount is applied to the gate of the transistor 42. As a result, an electric current flows from the capacitor 51 through the transistor 42 to thereby discharge the capacitor 51. As a result, the voltage V4*a* falls.

When desiring to output the element output voltage V4*b* of a desired amount, a voltage V43 of a corresponding amount is first applied to the gate of the transistor 43. As a result, an electric current flows through the transistor 43 from the voltage source 62 to charge up the capacitor 52 (C2), whereby the element output voltage V4*b* rises to the desired amount. When desiring to stop outputting the element output voltage V4*b,* a voltage V44 of the corresponding amount is applied to the gate of the transistor 44. As a result, an electric current flows from the capacitor 52 through the transistor 44 to thereby discharge the capacitor 52. As a result, the voltage V4*b* falls.

Each of the transistors 41–44 has an ON resistance (drain-source resistance) whose amount decreases also in accordance with increases of the inputted drive voltage V41–V44 (gate-source voltage). Accordingly, when a small amount of the drive voltage V41 (V43) is applied to the transistor 41 (43), the drain voltage V4*a* is applied to the transistor 41 (43), the drain voltage V4*a* (V4*b*) rises slowly to a level that corresponds to the amount of the drive voltage V41 (V43). On the other hand, when a large amount of the drive voltage V41 (V43) is applied to the transistor 41 (43), the drain voltage V4*a* (V4*b*) will rapidly rise to a higher level that corresponds to the increased amount of the drive voltage V41 (V43). Similarly, when a small amount of the drive voltage V42 (V44) is applied to the transistor 42 (44), the drain voltage V4*a* (V4*b*) falls slowly. However, when a large amount of the drive voltage V42 (V44) is applied to the transistor 42 (44), the drain voltage V4*a* (V4*b*) will rapidly fall. Thus, as the amounts of the voltage V41–V44 are increased in order to increase the amount of the drain voltage V23, the rate, at which the voltages V4*a* and V4*b* rise and fall, also increases, thereby decreasing the time period required for the voltage V23 to rise and the time period required for the voltage V23 to fall.

The above-described characteristics of the element driving circuit 4 can also serve to cancel out the characteristic of the actuator 105 whose capacitance increases with increase in the amount of the applied voltage V23. Accordingly, even when the capacitance of the actuator 105 increases according to the increase in the level of the drain voltage V23, both the rising edge time Tr and the falling edge time Tf of the drive waveform V23 can be maintained as being substantially fixed.

The control portion 70 is for controlling output timings of the voltages V41–V44 and for controlling the amount of the voltages V41–V44.

Figure 9A:
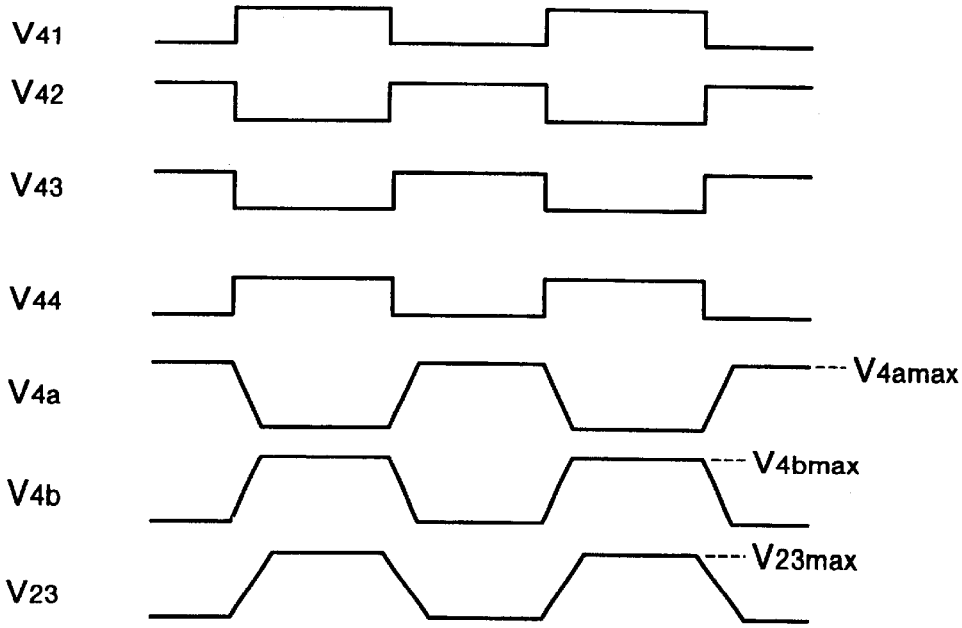
FIG. 9A shows timing charts how voltages V41–V44, V4*a*, V4*b*, and V23 are repeatedly developed in order to control the actuator to successively eject ink droplets.

In order to control the actuator 105 to successively eject ink droplets from the corresponding ink chamber 104, the actuator 105 should be charged and then discharged repeatedly. Accordingly, the control portion 70 supplies the voltage V41–V44 to the gates of the transistors 41–44 at timings as shown in FIG. 9A. As a result, element drive voltages V4*a* and V4*b* are repeatedly developed, as also shown in FIG. 9A, on the drains of the transistors 41–44. That is, the voltage V4*a* repeatedly rises to and falls from a level V4amax, that correspond to the amounts of the voltage V41 and V42, and the voltage V4*b* repeatedly rises to and falls from a level V4bmax, that corresponds to the amount of the voltages V43 and V44. In response to the thus developed element drive voltages V4*a* and V4*b*, the drive voltage V23 is repeatedly developed at the drains of the transistors 2 and 3 at timings also shown in FIG. 9A. That is, the voltage V23 repeatedly rises to and falls from a level V23max, that corresponds to the amounts of the voltages V4amax and V4bmax. The drive voltage V23 will be developed on the actuator 105 to repeatedly rise and fall at a certain rising edge time Tr and at a certain falling edge time Tf.

Figure 9B:
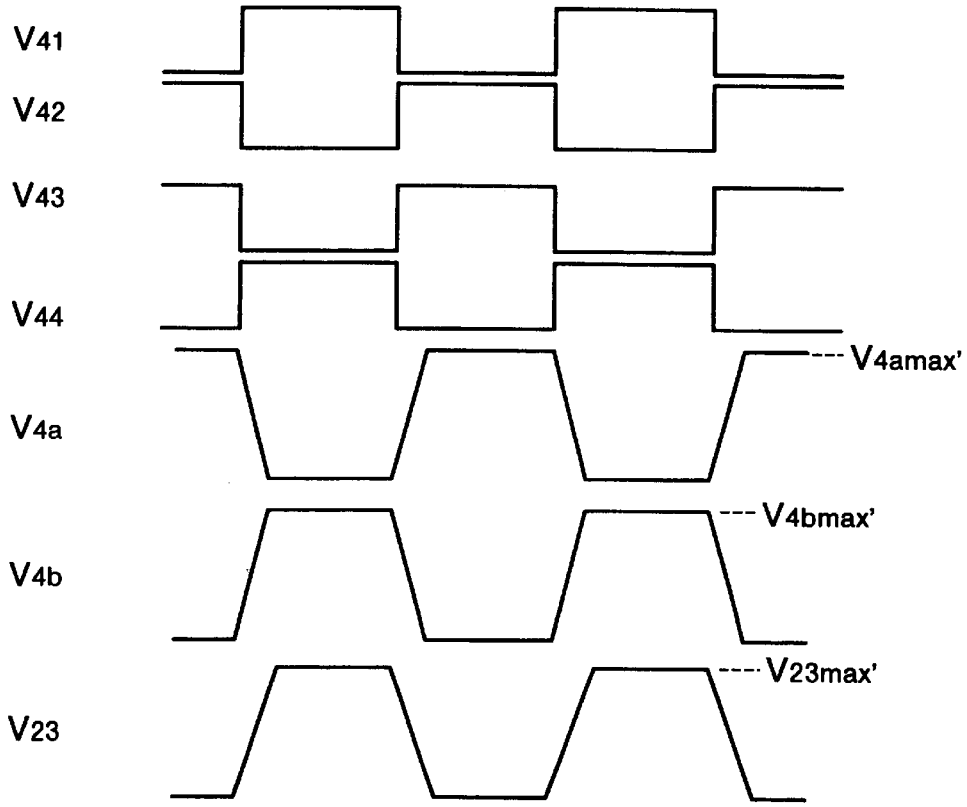
FIG. 9B shows timing charts how voltages V41–V44, V4*a*, V4*b*, and V23 are repeatedly developed, in order to control the actuator to successively eject ink droplets, the amounts of the voltages V41–V44, V4*a*, V4*b*, and V23 being increased relative to the case of FIG. 9A.

When the property of ink changes according to changes in the ambient temperature, it is desired to increase the amount of the voltage V23 applied to the actuator 105. In this case, the control portion 70 outputs the voltages V41–V44 to the transistors 41–44, while increasing the amounts of the voltages V41–V44, as shown in FIG. 9B. As a result, the element drive voltages V4*a* and V4*b* are repeatedly developed, as also shown in FIG. 9B, on the drains of the transistors 41–44. That is, the voltage V4*a* repeatedly rises to and falls from a level V4amax', that correspond to the increased amounts of the voltage V41 and V42, and the voltage V4*b* repeatedly rises to and falls from a level V4*b*max', that corresponds to the increased amounts of the voltages V43 and V44. That is, V4*a*max'>V4*a*max, and V4*b*max'>V4*b*max. Because ON-resistances of the transistors 41–43 are smaller than those in FIG. 9A, the element drive voltages V4*a* and V4*b* rise and fall, at a higher rate, than those of FIG. 9A.

In response to the element drive voltages V4*a* and V4*b* thus developed on the output terminals 4*a* and 4*b,* the drive voltage V23 will be developed on the drains of the transistors 2 and 3. That is, the voltages V23 repeatedly rises to and falls from a level V23max', that corresponds to the increased amounts of the voltages V4*a*max' and V4*b*max'. That is, V23max'>V23max. It is noted that the element drive voltages V4*a* and V4*b* repeatedly rise and fall, at a higher rate, to and from the higher levels V4*a*max' and V4*b*max' than those in the case of FIG. 9A. Accordingly, the drive voltage V23 will rise and fall at a higher rate to and from the higher levels V23max' than that in the case of FIG. 9A. Accordingly, even when the capacitance of the actuator 105 increases in accordance with the increase of the drive voltage V23, the drive voltage will be developed on the actuator 105 to rise and fall with the rising edge time Tr and the falling edge time Tf being maintained as substantially the same as that of the case of FIG. 9A.

Figure 10:
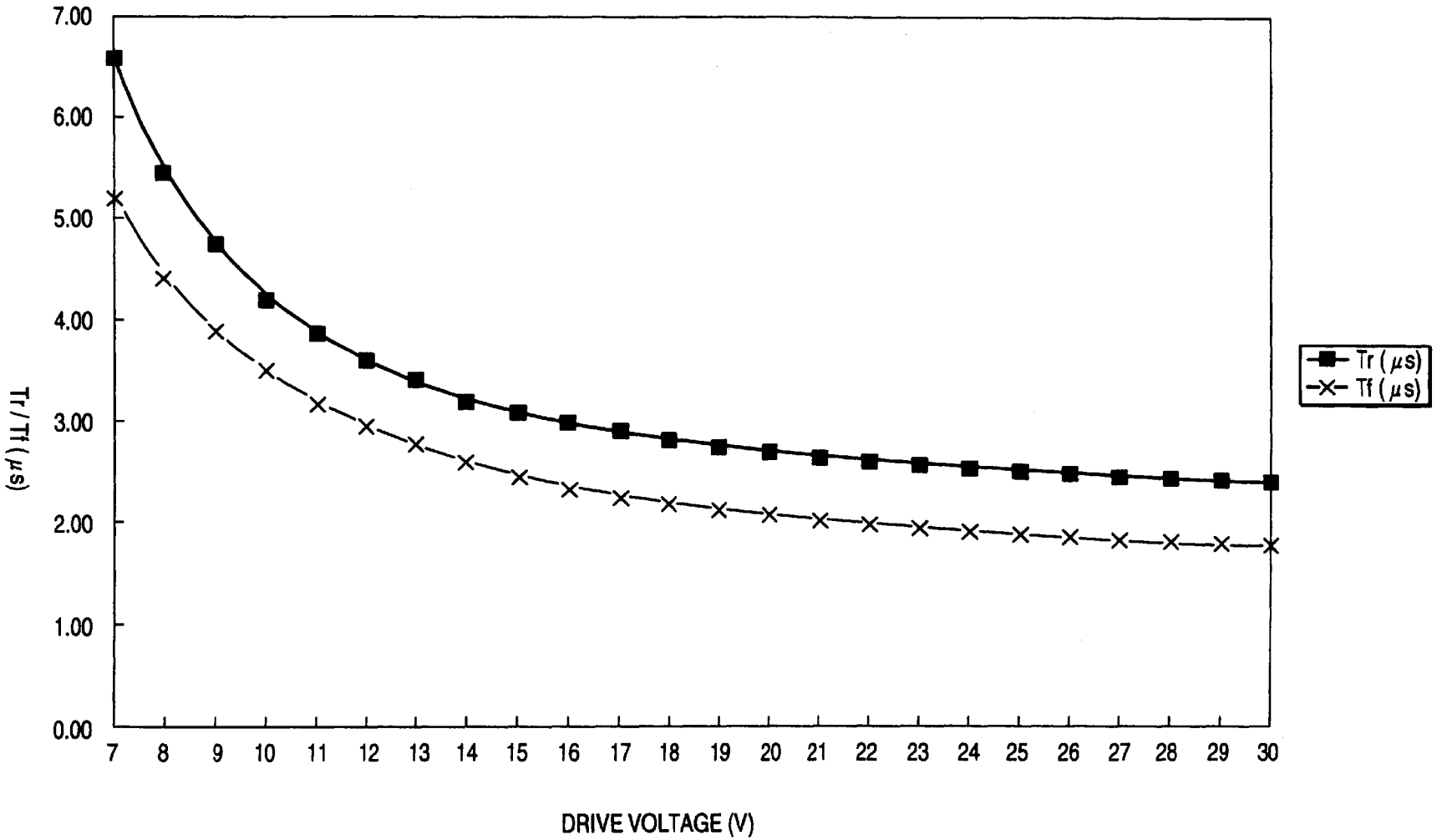
FIG. 10 is a graph showing a relationship between a drive voltage, applied to a capacitor whose capacitance is fixed to 3,600 pF, for example, and a rising edge time and a falling edge time of the actuator drive.

As described above, the drive circuit 1 of the present embodiment is configured from the transistors 2 and 3 and the element drive circuit 4. FIG. 10 shows the situation how the rising edge time Tr and the falling edge time Tf, of the actuator drive waveform V23, change with changes in the amount of the drive voltage V23 when a capacitor with a fixed capacitance of 3,600 pF is used in place of the actuator 105. As apparent from FIG. 10, as the amount of the voltage V23 increases, both the rising edge time Tr and the rolling edge time Tf of the actuator drive waveform V23 decrease.

Figure 11:
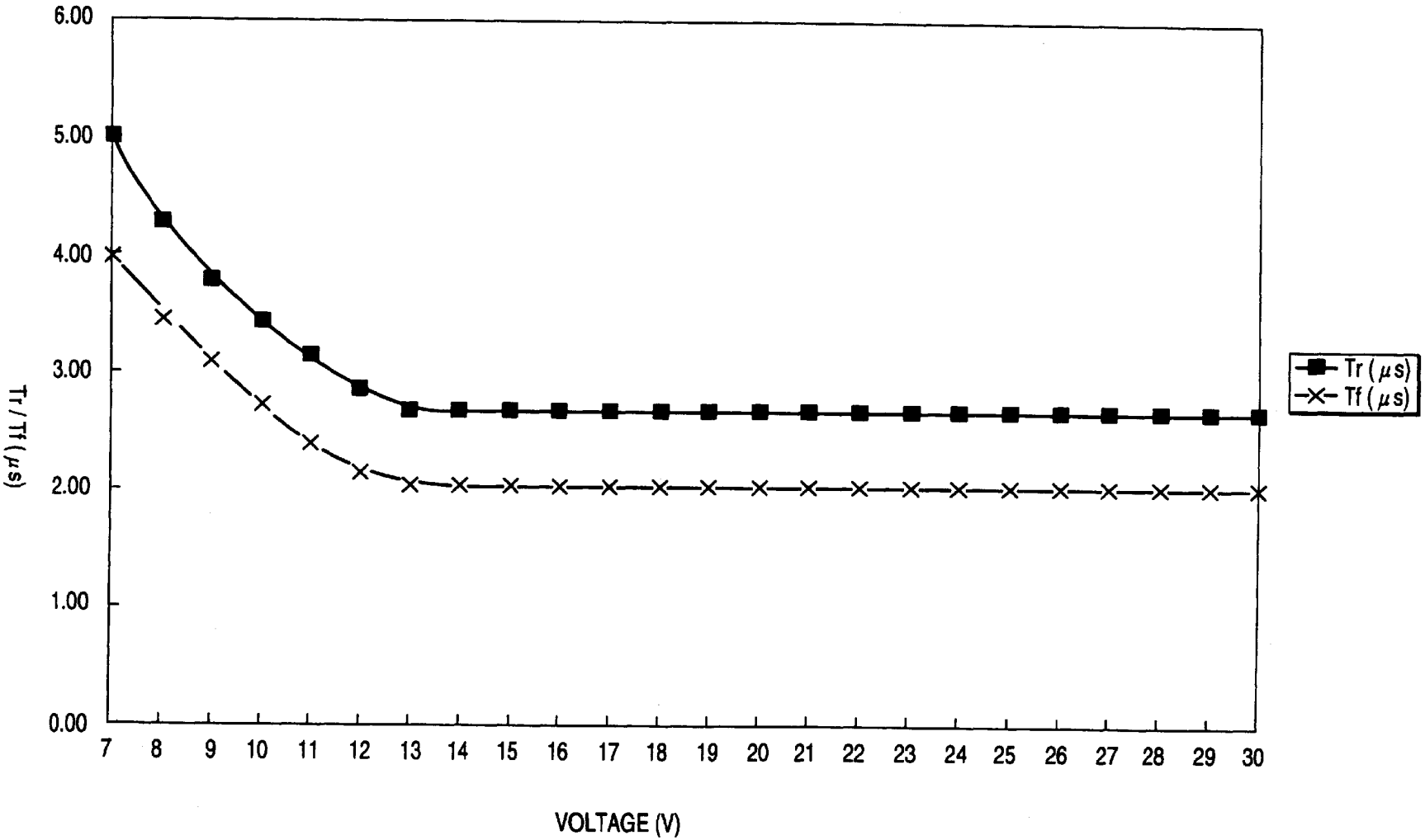
FIG. 11 is a graph showing a relationship between a drive voltage, applied to a piezoelectric element-formed actuator with a capacitance of 3,600 pF, for example, and a rising edge time and a falling edge time to the actuator drive.

This is because the drive circuit 1 that is constructed from the transistors 2 and 3 and the element drive circuit 4 has a characteristic for increasing the rate, at which the drive voltage V23 rises and falls, according to the increase in the amount of the drive voltage V23. Thus, the drive circuit 1 shortens the rising edge time Tr and the falling edge time Tf of the drive waveform V23 in association with the increase of the drive voltage amount V23. Accordingly, even when the actuator 105 has a characteristic wherein its capacitance increase in association with increase in the amount of the applied voltage V23, this characteristics of the actuator 5 can be canceled out by the characteristic of the drive circuit 1, so that the rising edge time Tr and the rolling edge time Tf will be maintained at approximately fixed over a broad range of the applied voltage amount V23. For example, when a 3,600 pF PZT piezoelectric element is used as the actuator 105, as shown in FIG. 11, the rising edge time Tr and the falling edge time Tf are maintained as approximately fixed within a wide range of 13 volts to 30 volts of the applied voltage amount V23.

As described above, the drive circuit 1 of the present embodiment drives the piezoelectric element actuator 105 that has characteristic wherein its capacitance increases in association with increase in the applied drive voltage V23. The drive circuit 1 includes the transistors 2 and 3 for outputting the drive voltage waveform V23 to the actuator (capacitor) 105, and the element drive circuit 4 for driving the transistors 2 and 3. The transistor 2 charges the capacitor 105 through supplying the capacitor 105 with the drive voltage waveform, and the transistor 3 discharges the capacitor 105 through supplying the capacitor 105 with the drive voltage waveform, and the transistor 3 discharges the capacitor 105 through supplying the capacitor 105 with the drive voltage waveform. Both of the transistors 2 and 3 have a characteristic wherein their ON resistances decrease with increase in the drive voltage V4*a* and V4*b* applied thereto. The element drive circuit 4 drives the transistors 2 and 3, while shortening the rising edge time and falling edge time of the drive waveforms V4*a* and V4*b* in accordance with increase in the drive voltage amounts V4*a* and V4*b*. In this way, the transistors 2 and 3 and the element drive circuit 4 cancel out the characteristic of the actuator 5. Accordingly, it becomes possible to perform a minute control operation to change the amount of the drive voltage V23, to be applied to the actuator 105, according to changes in properties of the ink while maintaining the ink ejection characteristics.

While the invention has been described in detail with reference to the specific embodiment thereof, it would be apparent to those skilled in the art that various changes and modifications may be made therein without departing from the spirit of the invention.

For example, according to the present invention, the transistors 2 and 3 have a characteristic wherein their ON resistances decrease with increase in applied voltages. Also, the element drive circuit 4 has a characteristic for driving the transistors 2 and 3 while shortening the rising edge time and falling edge time of the drive waveform in accordance with increase in the drive voltage amount. Thus, the transistors 2 and 3 and the element drive circuit 4 can cooperate to achieve the characteristic line shown in FIG. 10.

However, if the transistors 2 and 3 have the characteristic that their ON resistance decreases with increase in the voltage amount, the element drive circuit 4 may not have the above-described characteristic to shorten the rising edge time and the falling edge time of the drive waveform with increase in the voltage amount. Similarly, if the element drive circuit 4 has a above-described characteristic to shorten the rising edge time and the falling edge time of the drive waveform with increase in the voltage amount, the transistors 2 and 3 may not have the characteristic that their ON resistance decreases with increase in the voltage amount. It is sufficient that only the transistors 2 and 3 have the characteristic that their ON resistance decreases with increase in the voltage amount or that only the element drive circuit 4 performs the driving operation to shorten the rising edge time and falling edge time of the drive waveform with increase in the voltage amount. In either case, characteristics similar to those time of the drive waveform with increase in the voltage amount. In either case, characteristics similar to those shown in FIG. 10 can be attained. By canceling out the tendency of the capacitor 105 to have its capacitance increase with increase in voltage, the raising edge time Tr and the falling time Tf can be maintained in the fixed values.

Although field effect transistors are used as output elements 2 and 3 in the above-described embodiment, NPN or PNP transistors could be used instead and still achieves the effects of the invention.

Although the above-described embodiment is directed to the drive circuit 1 for a print head that employs the actuator 105 formed from piezoelectric material, the present invention can be applied to any other drive circuits for any actuators whose capacitance changes in association with changes in the applied drive voltage. For example, the present invention can be applied to a drive circuit for an ultrasonic motor.

In the above-described embodiment, the drive voltage V23 is applied to the actuator (side wall) 105 so that the volume of the corresponding ink chamber 104B is increased, and then the application of the drive voltage V23 is stopped, so that the volume of the ink chamber 104B is reduced to its natural state, and an ink droplet is ejected from the ink chamber 104B. However, it may be adopted that the drive voltage V23 be first applied so that the volume of the ink chamber 104B be reduced to eject the ink droplet from the ink chamber 104B, and then the application of the drive voltage V23 is stopped so that the volume of the ink chamber 104B is increased from its reduced state to its natural state to supply the ink into the ink chamber 104B.

What is claimed is:

1. A drive circuit for applying a drive voltage to an actuator whose capacitance increases with an increase in the amount of the drive voltage, the drive circuit comprising:

an output element for outputting a drive voltage in a driving waveform; and an element driving circuit for driving the output element, both of the output element and the element driving circuit having a characteristic to decrease a rising edge time period and a falling edge time period of the driving waveform in accordance with an increase in the amount of the drive voltage, wherein the output element includes:

a first transistor for electrically charging the actuator; and a second transistor for electrically discharging the actuator, each of the first and second transistors having an ON resistance that decreases according to an increase in the amount of an output element driving voltage outputted form the element driving circuit to each of the first and second transistors, wherein each of the first and second transistors is a field-effect transistor having a source, a drain, and a gate, the source of the first transistor being connected to a voltage source, the source of the second transistor being grounded, drains of the first and second transistors being connected to one terminal of the actuator, and gates of the first and second transistors being connected to the element driving circuit, and wherein the element driving circuit includes:

a control portion;

a first pair of transistors and a first capacitor, each of the first pair of transistors being a field-effect transistor having a source, a drain, and a gate, the source of one of the first pair of transistors being connected to the voltage source, the source of the other transistor being grounded, drains of both of the first pair of transistors being connected to one terminal of the first capacitor and to the gate of the first transistor, and the gates of both of the first pair of transistors being connected to the control portion, the other terminal of the first capacitor being grounded; and a second pair of transistors and a second capacitor, each of the second pair of transistors being a field-effect transistor having a source, a drain, and a gate, the source of one of the second pair of transistors being connected to the voltage source, the source of the other transistor being grounded, drains of both of the second pair of transistors being connected to one terminal of the second capacitor and to the gate of the second transistor, and the gates of both of the second pair of transistors being connected to the control portion, the other terminal of the second capacitor being grounded.

2. A drive circuit as claimed in claim 1, wherein at least one of the output element and the element driving circuit has a characteristic to increase a rate, at which the drive voltage rises to a predetermined driving level and falls from the predetermined driving level in the driving waveform, in accordance with increase in the value of the predetermined driving level.

3. A drive circuit as claimed in claim 1, wherein the element driving circuit performs a driving operation to output the output element driving voltage in an element driving waveform, while decreasing a rising edge time and a falling edge time of the element driving waveform when increasing the amount of the output element driving voltage.

4. A drive circuit as claimed in claim 3, wherein the element driving circuit outputs the output element driving voltage while increasing a rate, at which the output element driving voltage rises to a predetermined element driving level and falls from the predetermined element driving level in the element driving waveform, in accordance with increase in the value of the predetermined element driving level.

5. A drive circuit as claimed in claim 1, wherein the actuator defines an ink chamber for being filled with ink, the actuator being formed with a nozzle in fluid communication with the ink chamber, the output element allowing the actuator to actuate upon application of the drive voltage, thereby causing ejection of an ink droplet through the nozzle from the ink chamber.

6. An actuator device, comprising:

an actuator whose capacitance increases with increase in an amount of a drive voltage applied thereto; and a drive circuit for applying the drive voltage to the actuator, the drive circuit applying the drive voltage in a driving waveform while decreasing a rising edge time period and a falling edge time period of the driving waveform in accordance with increase in the amount of the drive voltage, wherein the drive circuit includes:

an output element for outputting the drive voltage in the driving waveform to the actuator; and an element driving circuit for driving the output element, both of the output element and the element driving circuit having a characteristic to decrease the rising edge time period and the falling edge trim period of the driving waveform in accordance with an increase in the amount of the drive voltage.

7. An actuator device as claimed in claim 6, wherein the drive circuit increases a rate, at which the drive voltage rises to a predetermined driving level and falls from the predetermined driving level in the driving waveform, when increasing the value of the predetermined driving level.

8. An actuator device as claimed in claim 6, wherein the output element includes:

a fist transistor for electrically charging the actuator; and a second transistor for electrically discharging the actuator, each of the first and second transistors having an ON resistance that decreases according to an increase in an amount of an output element driving voltage outputted from the element driving circuit to each of the first and second transistors, wherein each of the first and second transistors is a field-effect transistor having a source, a drain, and a gate, the source of the first transistor being connected to a voltage source, the source of the second transistor being grounded, drains of the first and second transistors being connected to one terminal of the actuator, and gates of the first and second transistors being connected to the element driving circuit, and wherein the element driving circuit includes:

a control portion;

a first pair of transistors and a first capacitor, each of the first pair of transistors being a field-effect transistor having a source, a drain, and a gate, the source of one of the first pair of transistors being connected to the voltage source, the source of the other transistor being grounded, drains of both of the first pair of transistors being connected to one terminal of the first capacitor and to the gate of the first transistor, and the gates of both of the first pair of transistors being connected to the control portion, the other terminal of the first capacitor being grounded; and a second pair of transistors and a second capacitor, each of the second pair of transistors being a field-effect transistor having a source, a drain, and a gate, the source of one of the second pair of transistors being connected to the voltage source, the source of the other transistor being grounded, drains of both of the second pair of transistors being connected to one terminal of the second capacitor and to the gate of the second transistor, and the gates of both of the second pair of transistors being connected to the control portion, the other terminal of the second capacitor being grounded.

9. An actuator device as claimed in claim 6, wherein the drive circuit includes:

an output element for outputting the drive voltage in the driving waveform to the actuator; and an element driving circuit for driving the output element, at least one of the output element and the element driving circuit having a characteristic to decrease the rising edge time period and the falling edge time period of the driving waveform in accordance with increase in the amount of the drive voltage.

10. An actuator device as claimed in claim 9, wherein at least one of the output element and the element driving circuit has a characteristic to increase a rate, at which the drive voltage rises to a predetermined driving level and falls from the predetermined driving level in the driving waveform, in accordance with increase in the value of the predetermined driving level.

11. An actuator device as claimed in claim 10, wherein the output element includes:

a first transistor for electrically charging the actuator; and a second transistor for electrically discharging the actuator, each of the first and second transistors having an ON resistance that decreases according to increase in an amount of an output element driving voltage outputted form the element driving circuit to each of the first and second transistors.

12. An actuator device as claimed in claim 11, wherein the element driving circuit performs a driving operation to output the output element driving voltage in an element driving waveform, while decreasing a rising edge time and a falling edge time of the element driving waveform when increasing the amount of the output element driving voltage.

13. An actuator device as claimed in claim 12, wherein the element driving circuit outputs the output element driving voltage while increasing a rate, at which the output element driving voltage rises to a predetermined element driving level and falls from the predetermined element driving level in the element driving waveform, in accordance with increase in the value of the predetermined element driving level.

14. An ink jet print head, the ink jet print head comprising:

an actuator defining an ink chamber for being filled with ink, the actuator being formed with a nozzle in fluid communication with the ink chamber, capacitance of the actuator increasing with increase in an amount of a drive voltage applied thereto; and a drive circuit for applying a drive voltage in a driving waveform to the actuator, thereby allowing the actuator to actuate and cause ejection of an ink droplet through the nozzle form the ink chamber, the drive circuit decreasing a rising edge time period and a falling edge time period of the driving waveform in accordance with increase in the amount of the drive voltage, wherein the drive circuit includes:

an output element for outputting the drive voltage in the driving waveform to the actuator; and an element driving circuit for driving the output element, both of the output element and the element driving circuit having a characteristic to decrease the rising edge time period and the falling edge time period of the driving waveform in accordance with an increase in the amount of the drive voltage.

15. An ink jet print head as claimed in claim 14, wherein the output element includes:

a first transistor for electrically charging the actuator; and a second transistor for electrically discharging the actuator, each of the first and second transistors having an ON resistance that decreases according to an increase in an amount of an output element driving voltage outputted from the element driving circuit to each of the first and second transistors, wherein each of the first and second transistors is a field-effect transistor having a source, a drain, and a gate, the source of the first transistor being connected to a voltage source, the source of the second transistor being grounded, drains of the first and second transistors being connected to one terminal of the actuator, and gates of the first and second transistors being connected to the element driving circuit, and wherein the element driving circuit includes:

a control portion;

a first pair of transistors and a first capacitor, each of the first pair of transistors being a field-effect transistor having a source, a drain, and a gate, the source of one of the first pair of transistors being connected to the voltage source, the source of the other transistor being grounded, drains of both of the first pair of transistors being connected to one terminal of the first capacitor and to the gate of the first transistor, and the gates of both of the first pair of transistors being connected to the control portion, the other terminal of the first capacitor being grounded; and a second pair of transistors and a second capacitor, each of the second pair of transistors being a field-effect transistor having a source, a drain, and a gate, the source of one of the second pair of transistors being connected to the voltage source, the source of the other transistor being grounded, drains of both of the second pair of transistors being connected to one terminal of the second capacitor and to the gate of the second transistor, and the gates of both of the second pair of transistors being connected to the control portion, the other terminal of the second capacitor being grounded.

16. An ink jet print head as claimed in claim 14, wherein the drive circuit includes:

an output element for outputting the drive voltage in the driving waveform to the actuator; and an element driving circuit for driving the output element, at least one of the output element and the element driving circuit having a characteristic to decrease the rising edge time period and the falling edge time period of the driving waveform in accordance with increase in the amount of the drive voltage.

17. An ink jet print head as claimed in claim 16, wherein at least one of the output element and the element driving circuit has a characteristic to increase a rate, at which the drive voltage rises to a predetermined driving level and falls from the predetermined driving level in the driving waveform, in accordance with increase in the value of the predetermined driving level.

18. An ink jet print head as claimed in claim 17, wherein the output element includes:

a first transistor for electrically charging the actuator; and a second transistor for electrically discharging the actuator, each of the first and second transistors having an ON resistance that decreases according to increase in an amount of an output element driving voltage outputted form the element driving circuit to each of the first and second transistors.

19. An ink jet print head as claimed in claim 18, wherein the element driving circuit performs a driving operation to output the output element driving voltage in an element driving waveform, while decreasing the rising edge time and the falling edge time of the element driving waveform when increasing the amount of the output element driving voltage.

20. An ink jet print head as claimed in claim 19, wherein the element driving circuit outputs the output element driving voltage while increasing a rate, at which the output element driving voltage rises to predetermined element driving level and falls from the predetermined element driving level in the element driving waveform, in accordance with increase in the value of the predetermined element driving level.

* * * * *